United States Patent [19]

Lea et al.

[11] 4,197,131

[45] Apr. 8, 1980

[54] DRY SILVER PHOTO-SENSITIVE COMPOSITIONS

[75] Inventors: Bernard D. Lea, London, England; Jack E. Reece, Forest Lake, Minn.

[73] Assignee: Minnesota Mining and Manufacturing Company, Saint Paul, Minn.

[21] Appl. No.: 964,479

[22] Filed: Nov. 29, 1978

[51] Int. Cl.[2] ..... G03C 1/02

[52] U.S. Cl. ..... 430/617; 430/964; 430/517

[58] Field of Search ..... 96/114.1, 84 R

[56] References Cited

U.S. PATENT DOCUMENTS

| | | | |
|---|---|---|---|
| 3,745,009 | 7/1973 | Jenkins et al. | 96/114.1 |
| 3,821,001 | 6/1974 | Weber | 96/114.1 |
| 4,033,948 | 7/1977 | Brown | 96/114.1 |
| 4,088,497 | 5/1978 | Brown | 96/114.1 |

OTHER PUBLICATIONS

Leonard et al., J.A.C.S., vol. 73, pp. 3325-3329, Jul. 1951.

*Primary Examiner*—Travis Brown

*Attorney, Agent, or Firm*—Cruzan Alexander; Donald M. Sell; Mark A. Litman

[57] ABSTRACT

Dry silver photo-sensitive compositions comprising an intimate mixture of a substantially light-insensitive silver compound which upon reduction gives a visible change and sufficient of a silver halide to catalyse said reduction to give a visible change in those areas where the silver halide has been exposed to light and when the mixture is heated in the presence of a reducing agent, and as a yellow acutance dye a 1-alkyl-4-nitro-methylene-quinolane, the alkyl substituent containing 1 to 4 carbon atoms.

15 Claims, No Drawings

DRY SILVER PHOTO-SENSITIVE COMPOSITIONS

This invention relates to photo-sensitive compositions and to the incorporation of acutance dyes in such systems. The invention is particularly concerned with photo-sensitive compositions of the type known as "dry silver" compositions.

Dry silver photo-sensitive compositions comprise an intimate mixture of a light sensitive silver halide and another silver compound such as a silver salt of an organic acid, e.g. silver behanate or silver saccharine, which upon reduction gives a visible change and which is substantially light-insensitive. Such a mixture is usually prepared in suspension and the resulting dispersion spread as a layer on a suitable substrate. When dry, the layer is exposed to a light image and thereafter a reproduction of the image can be developed by heating the layer in the presence of a reducing agent such as hydroquinone or certain substituted phenols.

It is because the exposure and development of the layer occur without using water, that these materials are often referred to as dry silver light-sensitive materials. Such materials, in which minor amounts of a photo-sensitive silver halide catalyst-progenitor, are associated in catalytic proximity with major amounts of a heat sensitive oxidation-reduction image forming reaction mixture which reacts more rapidly in the presence of the catalyst resulting upon exposure of the silver halide are well known in the art. Examples of such materials are described in our British Pat. No. 1 110 046 and in U.S. Pat. Nos. 3 839 049 and 3 457 075.

We believe, that when the mixture is exposed to light, a latent image is formed in the silver halide. Thereafter, the silver compound can be reduced by heating with the reducing agent, this reduction being catalysed imagewise by the light exposed silver halide. By a suitable choice of temperature, the reduction of the silver compound can be catalysed in the light exposed areas to give a visible darkening while any slight reduction which occurs in the non-light exposed areas is insufficient to give a marked change. Of course, because the silver halide acts as a catalyst progenitor, only very small amounts of it can suffice, e.g. 0.1 to 10% by weight of the mixture. However, larger amounts, e.g. up to 15 or even 20% may be desirable in some circumstances.

In order to improve the sharpness or definition of photographic images, a dye known as an acutance dye is often incorporated into photo-sensitive compositions. The acutance dye will absorb at the wavelengths at which the photo-sensitive composition is sensitive. The longer the path length of the light in the layer of light sensitive composition the greater the attenuation. Therefore, scattered light is attenuated or absorbed to a larger extent than light which impinges directly on a light-sensitive crystal. As a result, therefore, although the overall speed of the composition is reduced slightly, scattered light and other light rays which are liable to produce a blurred image are preferentially absorbed and so the overall definition and sharpness of images produced in the layer are increased.

An acutance dye for use in a dry silver composition is preferably heat labile, that is to say, that it is destroyed by the heat development of the dry silver composition to one or more compounds which are colourless. It is therefore an object of this invention to provide dry silver compositions which contain yellow acutance dyes, i.e. those which will absorb blue light, the dyes being rendered colourless upon heat development of the dry silver composition.

According to the invention there is provided a light-sensitive composition comprising an intimate mixture of a substantially light-insensitive silver compound which upon reduction gives a visible change and sufficient of a silver halide to catalyse this reduction to give a visible change in those areas where the silver halide has been exposed to light and the mixture is heated in the presence of a reducing agent, and as a yellow acutance dye a 1-alkyl-4-nitromethylene-quinolane, the alkyl substituent containing 1 to 4 carbon atoms and preferably being a methyl or ethyl substituent.

This 1-alkyl-4-nitromethylene-quinolane can have the general formula:

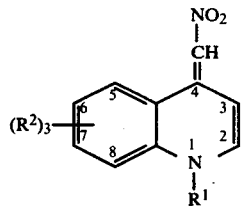

in which $R^1$ represents an alkyl group containing 1 to 4 carbon atoms, and each $R^2$ independently represents a substituent which can be present in a quinoline dye.

Examples of substituents which can be represented by each of the substituents $R^2$ are a hydrogen or halogen atom, e.g. chlorine, bromine or iodine, an alkyl group containing 1 to 4 carbon atoms, an alkoxy group containing 1 to 4 carbon atoms, an alkenyl group containing 2 to 4 carbon atoms, $-(CH_2)_nCOOH$ where n is 0, 1, 2 or 3, $-NO_2$, $-NH_2$ or $-NHCOCH_3$, or two groups $R^2$ together represent the carbon atoms needed to complete a fused on benzene ring, e.g. fused on at the 7 and 8 positions. Preferably at least one and possibly at least two of the substituents $R^2$ represent hydrogen atoms. The most preferred substituents to be represented by each $R^2$ are hydrogen, chlorine, or bromine atoms, or methyl, ethyl, methoxy or ethoxy groups.

It is found that dry silver compositions containing one of the above noted acutance dyes can give excellent sharp images and that the acutance dye will be rendered colourless by the heating required to develop the composition. This is surprising in view of the fact that these dyes are found not to be decomposed to a colourless state when they are heated on their own to the temperature at which the dry silver compositions are heated for development.

The acutance dyes used in the compositions of the invention can be prepared by processes which are well known. Thus, they can be prepared in a manner analogous to the synthesis of simple merocyanine dyes as described, for example, in British Pat. No. 426 718, by reacting nitromethane with a 1-alkyl-4-alkylthio-quinolinium salt in a solvent in the presence of a basic catalyst. They are, however, preferably prepared from 1-alkyl-quinolinium salts by the method described by Leonard, DeWalt and Leubuer in J.A.C.S., 73, 3328, in which a quinolinium quaternary salt is heated with nitromethane in the presence of a base, an oxidising agent and a solvent.

Examples of acutance dyes which can be used according to the invention are those having the values of $R^1$ and one of the substituents $R^2$, the remaining substituents $R^2$ representing hydrogen atoms, as set out in the following Table 1.

Table 1

| Compound | $R^1$ | $R^2$ | Melting point °C. | | λ max (nm) |
|---|---|---|---|---|---|
| 1 | $CH_3$— | H— | 204 | (d) | 466 |
| 2 | $CH_3$— | 6-$CH_3O$— | 213-215 | (d) | 473 |
| 3 | $CH_3$— | 6-$CH_3$— | 208-210 | (d) | 470 |
| 4 | $C_2H_5$— | H— | 157-159 | | 469 |
| 5 | $CH_3$— | 6-Cl— | 238 | (d) | 476 |
| 6 | $C_2H_5$— | 6-Cl— | 171 | (d) | 475 |
| 7 | $CH_3$— | 8-$CH_3O$— | 208 | (d) | 463 |
| 8 | $C_2H_5$— | 8-$CH_3O$— | 173-175 | (d) | 467 |

(d) = with decomposition after melting.

The acutance dyes can be incorporated into the compositions of the invention in an amount from $5\times10^{-4}$ to 0.1 mole of actuance dye per kilogram of total dry solids in the composition. Preferably, however, the dyes are incorporated in an amount of from $2\times10^{-3}$ to $3\times10^{-2}$ mole of actuance dye per kilogram of dry solids in the composition.

The light-sensitive compositions of the invention will normally be spread for use on a support, suitable supports including, for example, paper, polyester or polyamide film bases, and glass. The composition will normally be prepared as a solution or suspension which is spread as a layer on the support and then the solvent or vehicle is evaporated off to leave a dry photo-sensitive layer. If desired, a coating aid or binder such as polyvinyl butyral, polymethyl methacrylate, cellulose acetate, polyvinyl acetate, cellulose acetate-propionate and cellulose acetate butyrate, can be incorporated in the light-sensitive mixture.

The substantially light-insensitive silver compound is suitably a silver salt of an organic acid. The organic acid can be a $C_{12}$ to $C_{29}$ aliphatic acid and is preferably a $C_{16}$ to $C_{25}$ aliphatic acid. Examples include silver behanate, silver caprate, silver laurate, silver myristate, silver palmitate, silver stearate, silver arachidate and silver saccharine.

The reducing agent for this substantially light-insensitive silver compound can normally be quite mild. Suitable examples include hydroquinone and substituted phenols such as 1-methyl-4-hydroxy-naphthalene, methyl gallate, catechol, phenylene diamine, p-aminophenol and 1-phenyl-3-pyrazolidone. The reducing agent can be incorporated into the light-sensitive composition. Alternatively, the composition can be placed in contact with the reducing agent after exposure to light. For example, a light-sensitive coating can be exposed to a light image, placed in contact with a layer containing the reducing agent and the image then developed by heating. Preferably, however, the reducing agent is incorporated in the light-sensitive composition before this is spread on the support. Then the storage stability of the composition can be improved by incorporating in the composition a small amount of a stablizier such as an acid stablizier, e.g. succinic acid, benzoic acid or salicylic acid.

The silver halide can be present in amounts of up to 20% by weight of the mixture of silver compounds or can be present in small amounts, e.g. 0.1 to 10% by weight of the mixture of silver compounds. It can be added as such to the substantially light-insensitive compound or formed in situ by adding a soluble halide, e.g. a mercury or sodium halide, to the substantially light-insensitive silver compound. The silver halide, can for example, be chloride, bromide or a mixture of them and/or other silver halides.

The light-sensitive compositions of the invention will not normally be dye sensitized but can include one or more sensitizing dyes to improve their sensitivity to parts of the spectrum other than the shorter wavelengths. Thus, dye sensitized dry silver compositions of the present invention can contain an additional acutance dye such as one of those described in our copending British Patent Application No. 16677/77.

Examples of dry silver compositions according to the invention containing various acutance dyes were tested as follows, all parts being by weight unless otherwise indicated.

A dry silver composition was first prepared. Under room light a 1000 gram dispersion containing 12.5 parts of silver behanate in 87.5 parts of solvent which in turn comprised 75 parts butan-2-one and 25 parts toluene was charged to a mixing vessel maintained at 15° C. Twenty grams of polyvinyl butyral resin (Butvar, B-76) and 10 grams of 1-methyl-2-pyrrolidinone were added, and the mixture stirred for 30 minutes.

Under Wratten 1A safelight a mixture containing hydrobromic acid (15 ml, 2.0 molar in ethanol), hydroiodic acid (7 ml, 0.1 molar in ethanol) and mercuric bromide (4 ml, 0.5 molar in ethanol) was added with stirring. After 30 minutes an additional 40 grams of the Butvar B-76 was added, followed after five minutes by 10 grams 2,6-bis(2'-hydroxy-3'-tertiary-butyl-5'-methylbenzyl)-4-methyl-phenol available from American Cyanamide under the name A080 and 6 grams phthalazinone. After 20 minutes 12 grams of a solution containing 2 mg of the following dye:

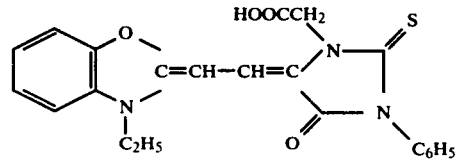

per gram of 1-methyl-2-pyrrolidinone was added and the mixture stirred for an additional 30 minutes.

Equimolar amounts of the acutance dyes to be tested were added to appropriate containers and dispersed in 2 ml of butane-2-one. Forty gram portions of the light-sensitive dispersion prepared above were added to each, the mixture shaken, left to stand 30 minutes, then shaken again prior to coating. Table 2 summarises the amounts of each dye added.

Table 2

| Composition | Dye No. | Molecular weight | Mg of dye in 2 ml butan-2-one |
|---|---|---|---|
| A | (Control) None | — | — |
| B | 1 | 202 | 7.2 |
| C | 2 | 232 | 8.3 |
| D | 3 | 216 | 7.7 |
| E | 4 | 216 | 7.7 |
| F | 5 | 260 | 9.3 |
| G | 6 | 250 | 8.9 |
| H | 7 | 232 | 8.3 |
| J | 8 | 246 | 8.8 |

Knife coatings 100 microns thick on polyester sheets were prepared from each sample and dried 3.5 to 4.0 minutes at 90° C. These dried coatings were overcoated with a solution containing 97 parts butane-2-one and 3 parts vinyl chloride vinyl acetate copolymer available from Union Carbide under the name VYNS with the knife set 50 microns above the base and dried as before.

The performance of these compositions was then evaluated.

A combination of a tungsten source, a narrow band filter, and an aperture target overlaid with a 0 to 4 continuous density wedge in a vacuum frame was used to make contact exposures at a wavelength closely matching the spectral absorbance maximum of each dye. Microdensitometer traces across the width of the image at D=2.0 (obtained after processing the exposed strips 20 seconds at 127° C. in a fluorocarbon oil bath to give reproducible heating for these tests) were used to judge the effectiveness of each dye.

The widths reported are the measured widths in centimeters of the density profile of each image as obtained from the microdensitometer chart. All measurements were carried out at D=1.5.

The results of testing the compositions are given in Table 3.

Table 3

| Coating of Composition | Microdensitometer traces: Target width cm | Microdensitometer traces: Image width cm | Flare | Background: Before Processing | Background: After Processing |
|---|---|---|---|---|---|
| A | 2.95 | 22.85 | 6.75 | pale pink | colourless |
| B | 2.90 | 8.76 | 2.02 | yellow | colourless |
| C | 2.95 | 7.60 | 1.58 | orange-yellow | colourless |
| D | 2.80 | 6.60 | 1.36 | yellow | colourless |
| E | 2.95 | 6.90 | 1.34 | yellow | colourless |
| F | 2.90 | 11.50 | 2.97 | orange-pink | colourless |
| G | 2.90 | 7.10 | 1.45 | orange-yellow | colourless |
| H | 2.75 | 13.30 | 3.84 | pink | colourless |
| J | 2.90 | 9.40 | 2.24 | yellow | very pale yellow |

$\text{Flare} = \frac{\text{Image width} - \text{target width}}{\text{target width}}$ for perfect results, flare = 0

All exposures made at 480 nm.

As can be seen from these results the presence of a yellow acutance dye in a dry silver composition according to the invention significantly reduces flare as compared with the dry silver composition A not containing any acutance dye.

What is claimed is:

1. A light-sensitive composition comprising an intimate mixture of a substantially light-sensitive silver compound which upon reduction gives a visible change and sufficient of a silver halide to catalyse said reduction to give a visible change in those areas where the silver halide has been exposed to light and when the mixture is heated in the presence of a reducing agent, and as a yellow acutance dye a 1-alkyl-4-nitromethylene-quinolane, the alkyl substitutent containing 1 to 4 carbon atoms.

2. A light-sensitive composition according to claim 1 wherein said alkyl substituent is selected from the group consisting of methyl and ethyl.

3. A light-sensitive composition according to claim 1 wherein the 1-alkyl-4-nitromethylene-quinolane has the general formula:

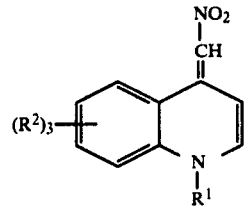

in which $R^1$ represents an alkyl group containing 1 to 4 carbon atoms, each $R^2$ is independently selected from the group consisting of a hydrogen or halogen atom, an alkyl group containing 1 to 4 carbon atoms, an alkenyl group containing 2 to 4 carbon atoms. $—(CH_2)_nCOOH$ where n is 0, 1, 2 or 3, $—NO_2$, $—NH_2$ or $NHCOCH_3$, or two groups $R^2$ together represent the carbon atoms required to complete a fused on benzene ring.

4. A light-sensitive composition according to claim 3 wherein $R^1$ is selected from the group consisting of a methyl or ethyl group, at least one group $R^2$ represents a hydrogen atom and each other $R^2$ is independently selected from the group consisting of a hydrogen, chlorine or bromine atom, or a methyl, ethyl, methoxy or ethoxy group.

5. A light-sensitive composition according to claim 3 in which the acutance dye is present in an amount of from $5\times10^{-4}$ to 0.1 mole per kilogram of dry solids in the composition.

6. A light-sensitive composition as claimed in claim 5 wherein at least two of said $R^2$ groups are hydrogen.

7. A light-sensitive composition according to claim 6 wherein $R^1$ is $CH_3$ and the third $R^2$ is H.

8. A light-sensitive composition according to claim 6 wherein $R^1$ is $CH_3$ and the third $R^2$ is $6—CH_3O$.

9. A light-sensitive composition according to claim 6 wherein $R^1$ is $CH_3$ and the third $R^2$ is $6—CH_3$.

10. A light-sensitive composition according to claim 6 wherein $R^1$ is $C_2H_5$ and the third $R^2$ is H.

11. A light-sensitive composition according to claim 6 wherein $R^1$ is $CH_3$ and the third $R^2$ is 6—Cl.

12. A light-sensitive composition according to claim 6 wherein $R^1$ is $C_2H_5$ and the third $R^2$ is 6—Cl.

13. A light-sensitive composition according to claim 6 wherein $R^1$ is $CH_3$ and the third $R^2$ is $8—CH_3O$.

14. A light-sensitive composition according to claim 6 wherein $R^1$ is $C_2H_5$ and the third $R^2$ is $8—CH_3O$.

15. A light-sensitive composition according to claim 5 wherein the acutance dye is present in an amount from $2\times10^{-3}$ to $3\times10^{-2}$ mole per kilogram of dry solids in the composition.

* * * * *